United States Patent [19]

Alger et al.

[11] Patent Number: 4,903,207

[45] **Date of Patent: * Feb. 20, 1990**

[54] METHOD FOR DETERMINING RESERVOIR BULK VOLUME OF HYDROCARBONS FROM RESERVOIR POROSITY AND DISTANCE TO OIL-WATER CONTACT LEVEL

[75] Inventors: Robert P. Alger, Buchanan Dam; Donald L. Luffel, Houston, both of Tex.

[73] Assignee: Restech, Inc., Houston, Tex.

[ * ] Notice: The portion of the term of this patent subsequent to Jan. 14, 2005 has been disclaimed.

[21] Appl. No.: 181,587

[22] Filed: Apr. 14, 1988

Related U.S. Application Data

[63] Continuation-in-part of Ser. No. 863,451, May 15, 1986, Pat. No. 4,751,646.

[51] Int. Cl.[4] ..... G01N 15/08; E21B 49/02

[52] U.S. Cl. ..... 364/422; 73/153; 324/376

[58] Field of Search ..... 364/422; 73/153, 38; 324/376

[56] References Cited

U.S. PATENT DOCUMENTS

| | | | |
|---|---|---|---|
| 4,211,106 | 7/1980 | Swanson | 73/38 |
| 4,506,542 | 3/1985 | Rose | 73/38 |
| 4,644,283 | 2/1987 | Vinegar et al. | 324/376 |
| 4,648,261 | 3/1987 | Thompson et al. | 73/38 |
| 4,751,646 | 6/1988 | Alger | 364/422 |

*Primary Examiner*—Clark A. Jablon

*Attorney, Agent, or Firm*—Dodge, Bush & Moseley

[57] ABSTRACT

For a formation zone of a well, a method for determining the relationship between bulk volume of oil $\phi_o$ as a function of total effective formation porosity $\phi_E$ and height h above the oil water contact from capillary pressure data of a core taken from the formation of the well is disclosed. The disclosed relationship of the form, $$\phi_0 = C\phi_E - K + g \log h$$

where C, K and g are constants derived from the capillary pressure data of the core and the relationship between h and the capillary pressure is affected by the relative densities of the connate water of the zone and the oil in the zone.

According to an alternative embodiment of the invention, log data may be used to characterize a well according to the relationship $$\phi_0 = C\phi_E - K + g \log h$$

by using sets of data at different depths in the well with statistical regression methods, where the initial oil-water contact level may be determined from said log data.

According to another alternative embodiment of the invention, core data may be used to determine the characterizing relation of a well, where the well does not penetrate the oil-water level of the reservoir as $$h(z) = 10^{(\phi_0(z) - C\phi_E(z) + K)/g}$$

but log data of the well exists. From the log data of the well, $\phi_o$ and $\phi_E$ may be determined as a function of depth. The water level WL=h(z)+z may be determined from the log data and the relationship determined from capillary pressure analysis of the core data. The WL determination as a function of each depth z may be compared to determine reservoir capillary equilibrium or when comparing WL determined for different wells to identify that these wells reside in different reservoirs.

12 Claims, 3 Drawing Sheets

FIG. 1
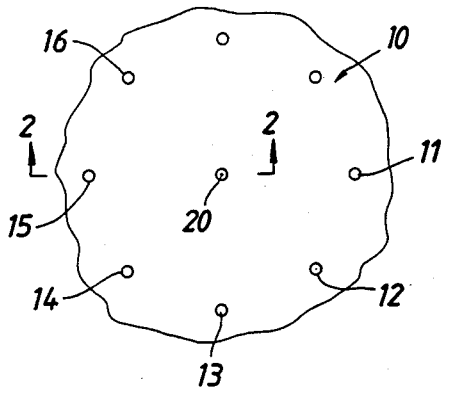
FIG. 2
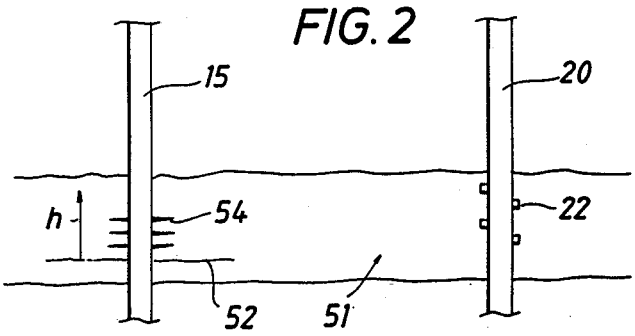
FIG. 3A
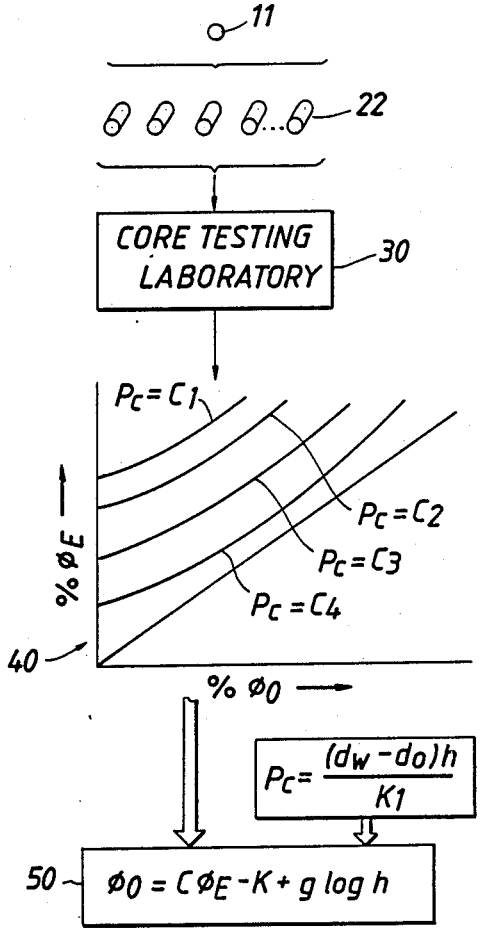
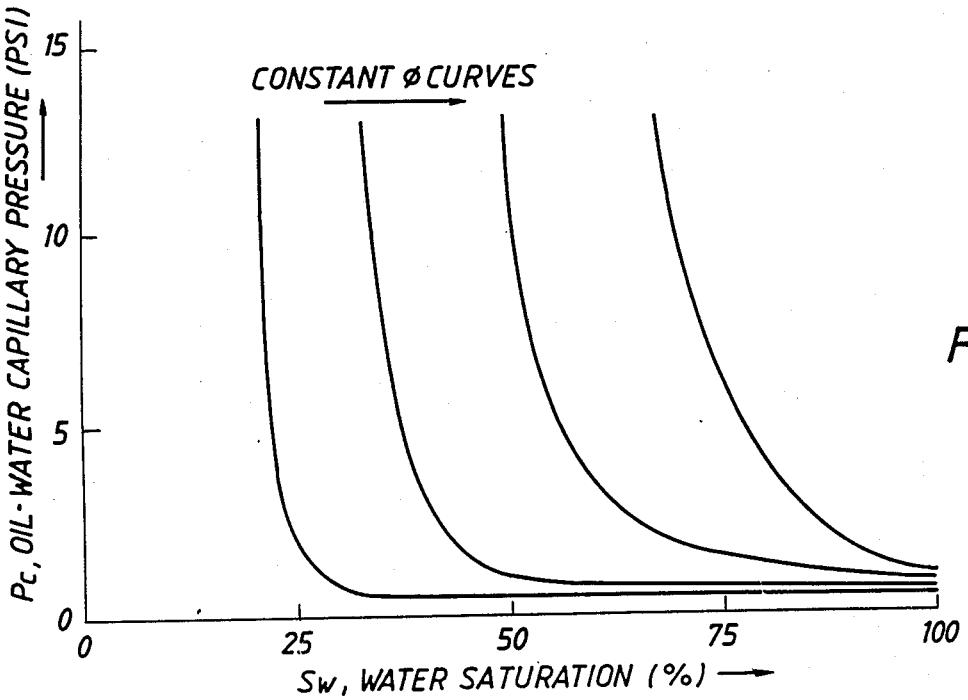
FIG. 3B

METHOD FOR DETERMINING RESERVOIR BULK VOLUME OF HYDROCARBONS FROM RESERVOIR POROSITY AND DISTANCE TO OIL-WATER CONTACT LEVEL

CROSS REFERENCE TO A RELATED APPLICATION

This application is a continuation- in-part of U.S. application Ser. No. 863,451, now U.S. Pat. No. 4,751,646.

BACKGROUND OF THE INVENTION

1. Field of the Invention

This invention relates in general to a method for determining the relationship between the original bulk volume of oil, effective porosity and height above the oil-water contact level for a well penetrating a reservoir. A first embodiment of the invention relates to a method for determining and recording as a function of depth, the original bulk volume of oil and saturations of a produced well using core data, and where an original porosity log does not exist, combining information from an original resistivity log to determine and record original bulk volume of oil and saturation. According to an alternative embodiment of the invention, well logs of a well are used exclusively to determine such relationship for the case where the well penetrates the oil-water contact level. According to another alternative embodiment of the invention where a well does not penetrate the oil-water contact level, core data and well log data are used to determine the depth of the oil-water contact level.

2. Description of the Prior Art

A paper by G. M. Heseldin entitled "A Method of Averaging Capillary Pressure Curves" published in the SPWLA Fifteenth Annual Logging Symposium, June 2-5, 1974 describes a method for determining an average capillary pressure curve for a particular rock type. Heseldin describes how capillary pressure data from a number of core samples of a zone of the formation can be plotted with constant capillary curves on an x-y grid where total effective porosity $\phi_E$ is measured on the y ordinate and bulk volume of oil, or $\phi_o$ is plotted on the x - abscissa. Heseldin describes a method of characterizing any curve as a displaced rectangular hyperbola of the form, $$(\phi_E - A)^2 = (\phi_o)^2 + B^2,$$

and then shows that the constants A and B are essentially linear with the logarithm of capillary pressure $P_c$.

A disadvantage of the Heseldin approach is that no single relationship is established by which the bulk volume of oil $\phi_o$ may be expressed as a function of effective porosity and capillary pressure $P_c$.

IDENTIFICATION OF OBJECTS OF THE INVENTION

It is an object of the invention to provide a method for determining a single function by which bulk volume of oil $\phi_o$ is related to the effective porosity $\phi_E$ and capillary pressure $P_c$ or height above the oil-water contact level in a zone of a hydrocarbon bearing reservoir which is obtained from capillary pressure analysis of a plurality of cores from that zone.

It is another object of the invention to apply the determined bulk volume of oil $\phi_o$ relationship to wells for which no porosity log $\phi_E$ exists, but where resistivity logs were obtained prior to production.

It is a further object of the invention to provide a method for determining the relationship between reservoir parameters of bulk volume of oil $\phi_o$, effective porosity $\phi_E$, and height above initial oil-water contact, without obtaining a capillary pressure analysis of cores from the reservoir, through the use of regression analysis of well logs taken before significant water table movement occurs, such well logs being indicative of effective porosity as $\phi_E$ as a function of depth, initial water saturation $S_{wi}$ as a function of depth (and by computation of the bulk volume oil oil $\phi_o$), and with a determination of the initial oil-water contact depth from such well logs.

It is a further object of the invention to provide a method for determination of height h above the oil-water contact of a reservoir at a particular depth d (and consequently the water level WL=d+h) where no wells with open-hole logs have been drilled deep enough to penetrate and locate the depth of the oil-water contact, but capillary pressure data are available from analysis of cores taken from at least one well.

It is a corollary object of the invention described immediately above to determine the capillary equilibrium of the reservoir or to identify wells that may be in separate reservoirs, from an analysis of water levels WL determined from a plurality of wells.

It is a further object of the invention to make it applicable in all of its forms not only to reservoirs which are presumed to contain oil, but also to gas or gas condensate reservoirs.

SUMMARY OF THE INVENTION

The objects, advantages and features of the method are incorporated in a method for determining the bulk volume of oil as a function of depth and effective porosity in a zone of a produced well. The first step of the method is to obtain core samples from a zone corresponding to the zone of a produced well. Usually this step includes forming a test bore in proximity to the produced well and obtaining a plurality of cores from the zone corresponding to the pay zone in the produced well. The core samples are laboratory tested to determine the relationship of bulk volume of oil $\phi_o$ as a function of capillary pressure $P_c$ and effective porosity $\phi_E$, that is $\phi_o = F(\phi_E, P_c)$.

Next the relationship between capillary pressure $P_c$ and height h above the oil-free water contact of the zone is determined of the form, $$h = \frac{K_1 P_c}{d_w - d_o}$$

where $d_w$ is the density of the connate water of the zone, $d_o$ is the density of oil in the zone, and $K_1$ is a constant of proportionality.

Next a second relationship of the form $$\phi_o = C\,\phi_E - K + g \log h$$

is determined from the core data and the relationship between $P_c$ and h. A log of $\phi_o(h)$ is then recorded from the second relationship by combining $\phi_E(h)$ data from a log of effective porosity of the zone.

Where a log of $\phi_E(h)$ was never obtained for the produced well, but a resistivity $R_t(h)$ exists for the well before it was produced, the second relationship described above can be rearranged to the form, $$\phi_o(h) = \frac{1}{1-C}\left[C\left(\frac{R_w}{R_t(h)}\right)^{\frac{1}{n}} - K + g\log h\right]$$

where $R_w$ is the resistivity of connate water of the zone, and n is a constant. The $R_t(h)$ log is then used with the relationship above to derive and record a log of original bulk volume of oil $\phi_o$ as a function of height above the oil-water contact level.

According to an alternative embodiment of the invention, log data may be used to characterize a well according to the relationship $$\phi_o = C\phi_E - K + g\log h$$

by using sets of data at different depths in the well with statistical regression methods, where the initial oil-water contact level may be determined from said log data.

According to another alternative embodiment of the invention, core data may be used to determine the characterizing relation of a first well as $$h = 10^{(\phi_o - C\phi E + K)/g}$$

where no well actually penetrates the oil-water contact. The depth as a function of well depth of such water-contact level may be determined from such relation with log data determinations of $\phi_o$ and $\phi_E$. The water-contact level as determined from depth to depth in a single well or from well to well may be compared to determine reservoir capillary equilibrium or to identify wells that may be in separate reservoirs.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown of which:

FIG. 1 is a plan view of an oil field in which a number of producing oil wells have been formed with one test well also being formed in the field;

FIG. 2 is a schematic illustration of a partial cross-section through the field showing a producing well through a pay zone and showing a test well through the pay zone in which core samples have been taken at varying depths through the zone;, FIG. 3A is a flow-chart type illustration showing steps required to develop the relationship of bulk volume of oil $\phi_o$ as a function of effective porosity and height above the oil-water contact level;

FIG. 3B shows a typical set of laboratory capillary pressure curves for four core samples of varying porosity.

DESCRIPTION OF THE INVENTION

Figure 3C:
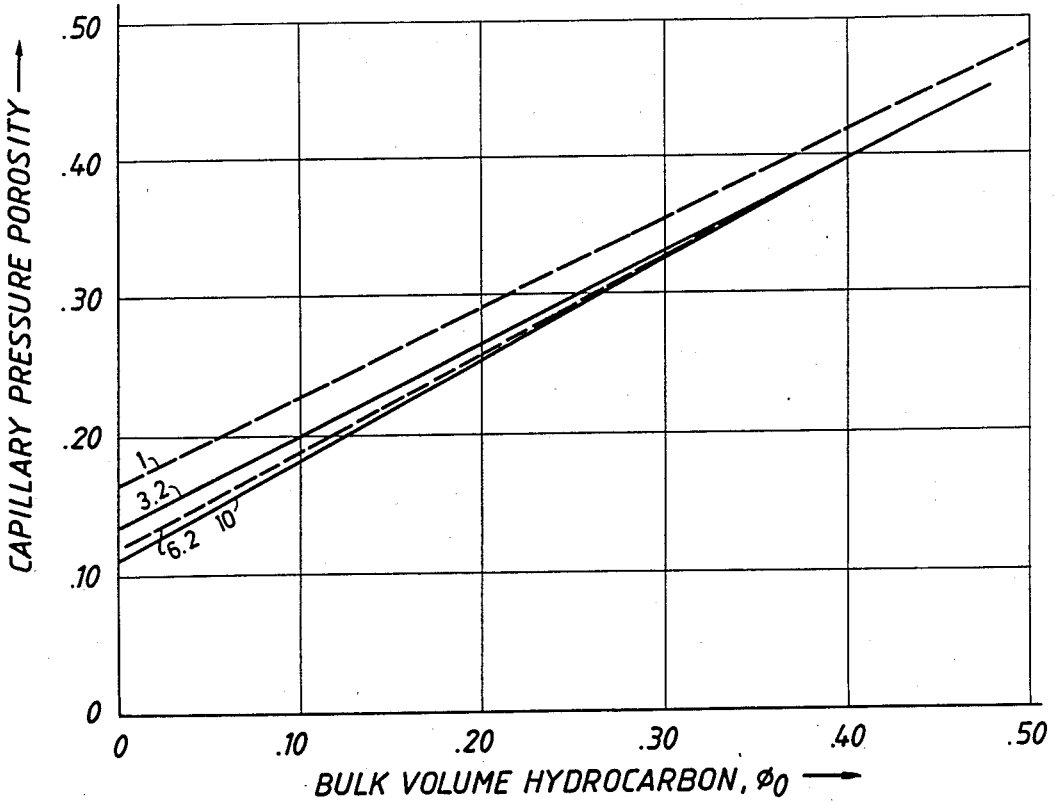
FIG. 3C is a graph of porosity versus bulk volume of oil for various levels of capillary pressure of a producing oil field and FIG. 3D is a graph showing the relationship between the height above the oil-water contact of a pay zone and an "intercept" developed for the relationship between bulk volume of oil and capillary pressure and said height.

Determination of a Characterizing Relationship Between $\phi_o$, $\phi_E$ and h for a Well Penetrating the Water-Oil Contact for which Capillary Pressure Data from Cores of the Reservoir is Available Many major oil fields were brought on production without adequate information as to the correct hydrocarbon volume originally present. While most wells were logged by an electrical log or survey, porosity logs were not yet developed and sidewall coring gave questionable results. This invention relates to running modern well logs and performing special core analysis procedures to evaluate current and original bulk volume of oil and correlative oil saturation for each individual well in the field.

FIG. 1 illustrates an oil field 10 in which produced wells 11–18 are shown and in which a test well 20 has been formed. FIG. 2 shows a cross-section through the formation pay zone 51 and illustrates old well 15 which has been cased, cemented and perforated by means of perforations 54. The oil-water contact level 52 is illustrated in pay zone 51 from which height h above that contact is measured and discussed in more detail below. The test well 20 is illustrated as extending through pay zone 51 and cores 22 are schematically illustrated as being taken from that zone.

FIG. 3A shows that the method according to the invention includes performing capillary pressure tests on the cores which have a range of bulk volume of oil $\phi_o$, capillary pressure $P_c$ and effective porosity $\phi_E$. Typically, the data obtained as suggested by the curves of FIG. 3A are obtained by pumping mercury into each sample. Mercury saturation is calculated as a percentage of pore volume in terms of pressures in order to establish capillary pressure curves by mercury injection (Purcell method). The testing procedure is described at pages 94–97 in a book, Properties of Reservoir Rocks: Core Analysis, by Robert P. Monicard, Gulf Publishing Company, Houston, Tex. 1980.

The functional relationship between $\phi_E$ and $\phi_o$ and $P_c$ is combined according to the invention and as indicated in FIG. 3A, with the relationship between capillary pressure and height above the oil-water contact level 52 to produce the relationship, $\phi_o = C\phi_e - K + g\log h$, where C, K and g are constants depending on the formation characteristics of the formation zone and the constants $d_w$, $d_o$ and $K_1$ represent respectively the density of connate water in the zone, density of oil in the zone and a constant of proportionality. The development of the relationship between $\phi_o$, $\phi_E$ and h is best explained by way of an actual example.

Capillary pressure data for 17 levels for the 5800 foot sand of the Tom O'Connor Field in Texas were tabulated for four different pressures (1.0, 3.2, 6.2, & 10 psi). FIG. 3B illustrates the laboratory capillary pressure curves for four samples. Values of water saturation $S_w$ are extracted for given $P_c$ levels for each sample. From the porosity and $S_w$, bulk volume of oil; BVH or $\phi_o$, is calculated:

$BVH=\phi_o=\phi(1-S_w)$.

FIG. 3C is a graph created from the data of FIG. 3B but shows the porosity $\phi$ plotted versus bulk volume of oil, $\phi_o$ for selected $P_c$ values of $P_c$—1.0, 3.2, 6.2 and 10 psi.

Linear relations between $\phi$ and BVH for each $P_c$ were developed. The resulting equations were:

| $P_c$ | BVH = |
|---|---|
| 1.0 | $1.5753\ \phi - .26005$ |
| 3.2 | $1.5156\ \phi - .20785$ |
| 6.2 | $1.4164\ \phi - .16667$ |
| 10.0 | $1.3607\ \phi - .14480$ |

FIG. 3C shows the plotted data for $P_c=1.0$ and lines were added for the three other equations. Parallelism among the curves, i.e., common slopes of the linear equation is not perfect when $P_c$ is high. It is therefore necessary to normalize the equations. An average slope is determined for the equations.

The average slope for the BVH (or $\phi_o$) equations for the $\phi$ term is 1.467, and the intercept is adjusted by the ratio of actual slope/new slope. The normalized equations are:

| | (slope) | (intercept) |
|---|---|---|
| $P_c = 1.0$ | BVH = 1.467 | $\phi - .24217$ |
| 3.2 | BVH = 1.467 | $\phi - .20120$ |
| 6.2 | BVH = 1.467 | $\phi - .16667$ |
| 10.2 | BVH = 1.467 | $\phi - .14480$ |

In this form, the intercept term (that is the numerical constants of each equation) varies with $P_c$, and thus with height above the water table. These intercepts may be related to the capillary pressure $P_c$.

When the in situ fluid densities $d_w$ (density of connate water) and $d_o$ (densities of oil in the zone) are obtained, the height above the water level is given by the equation $$h = \frac{K_1 P_c}{d_w - d_o} \text{ or } P_c = \frac{(d_w - d_o)\,h}{K_1}.$$

In the Tom O'Connor Field it is known that $d_w=1.03$ and $d_o=0.69$ gm/cc and $K_1=2.3$. Thus, one $P_c$ unit is equivalent to 6.76 feet.

Figure 3D:
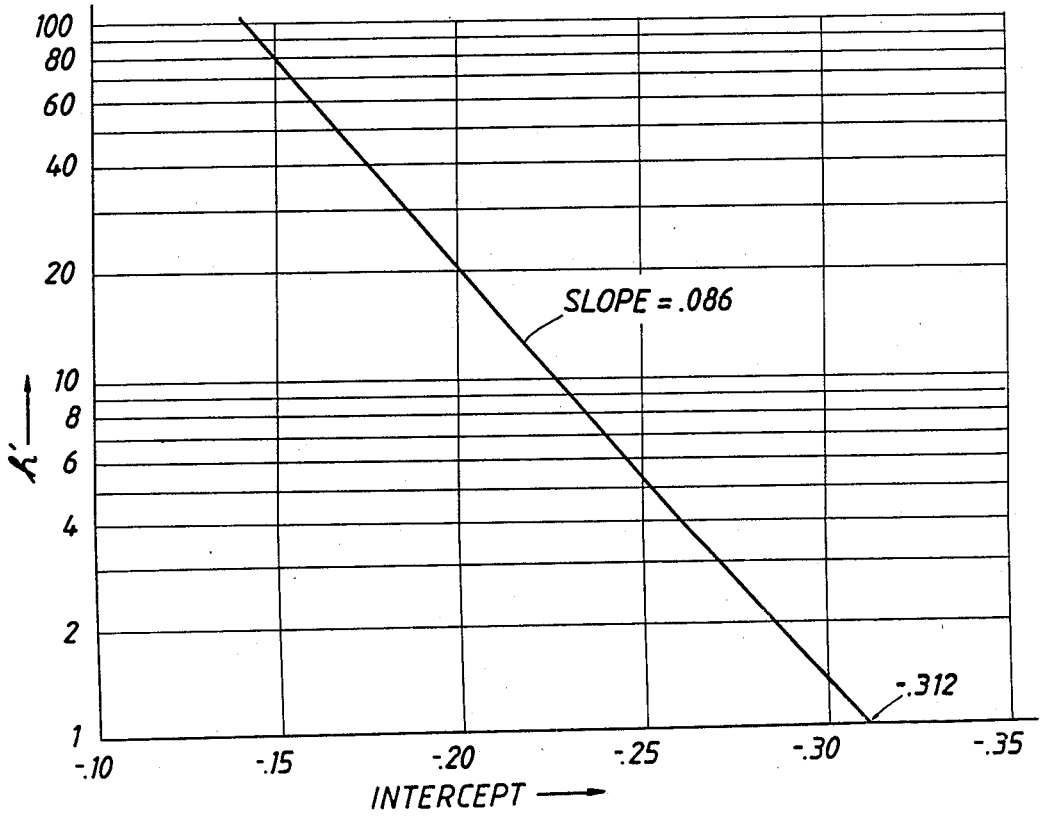

It has been found that the intercept of each normalized equation is functionally related to h. FIG. 3D shows a plot of log h vs the normalized intercept. The trend line gives two pieces of data: The value of the intercept where log h=0 (h=1') and the slope of the trend. For this case the log h=o value is −0.312 and the slope is 0.086. This relationship is inserted in the normalized equations to produce a single general equation:

$$BVH=1.467\ \phi_E-0.312+0.086 \log h.$$

In general therefore, the bulk volume of oil BVH or $\phi_o$ can be expressed from capillary pressure measurements from core data as, $$\phi_o=C\phi_E-K+g \log h. \quad (1)$$

It should be emphasized that where the term bulk volume of oil BVH is used, the invention applies to determination of Bulk Volume of Hydrocarbons, in a reservoir formation. In a particular reservoir, the hydrocarbons may be gas or gas condensate rather than liquid crude oil.

Although a graphical determination of the relationship expressed above has been demonstrated, statistical multi-linear regression techniques may be used. For example, the multiple curves of FIG. 3A of porosity $\phi_E$ as a function of BHV (or $\phi_o$ and capillary pressure $P_c$ or height h may be represented by a multi-linear regression with BHV as the dependent variable. The multi-linear regression analysis produces a relationship among the variables $\phi_o$ (or BHV) and $\phi_E$ and h with a determination of numerical constants C, K and g and also produces a correlation coefficient (r) and a standard deviation ($\sigma$) of the BHV relationship. An advantage of multi-linear regression is that numerical parameters characterize how good the relationship fits the capillary pressure data and log data. It is also useful to assess the effect on goodness of fit of adding or changing a term (such as using h rather than log h) in the relationship (1). It has been found that generally, use of the term log h in equation 1 gives a better correlation coefficient than h alone, but use of h alone in the relation may sometimes prove to be superior or more useful.

Figure 4:
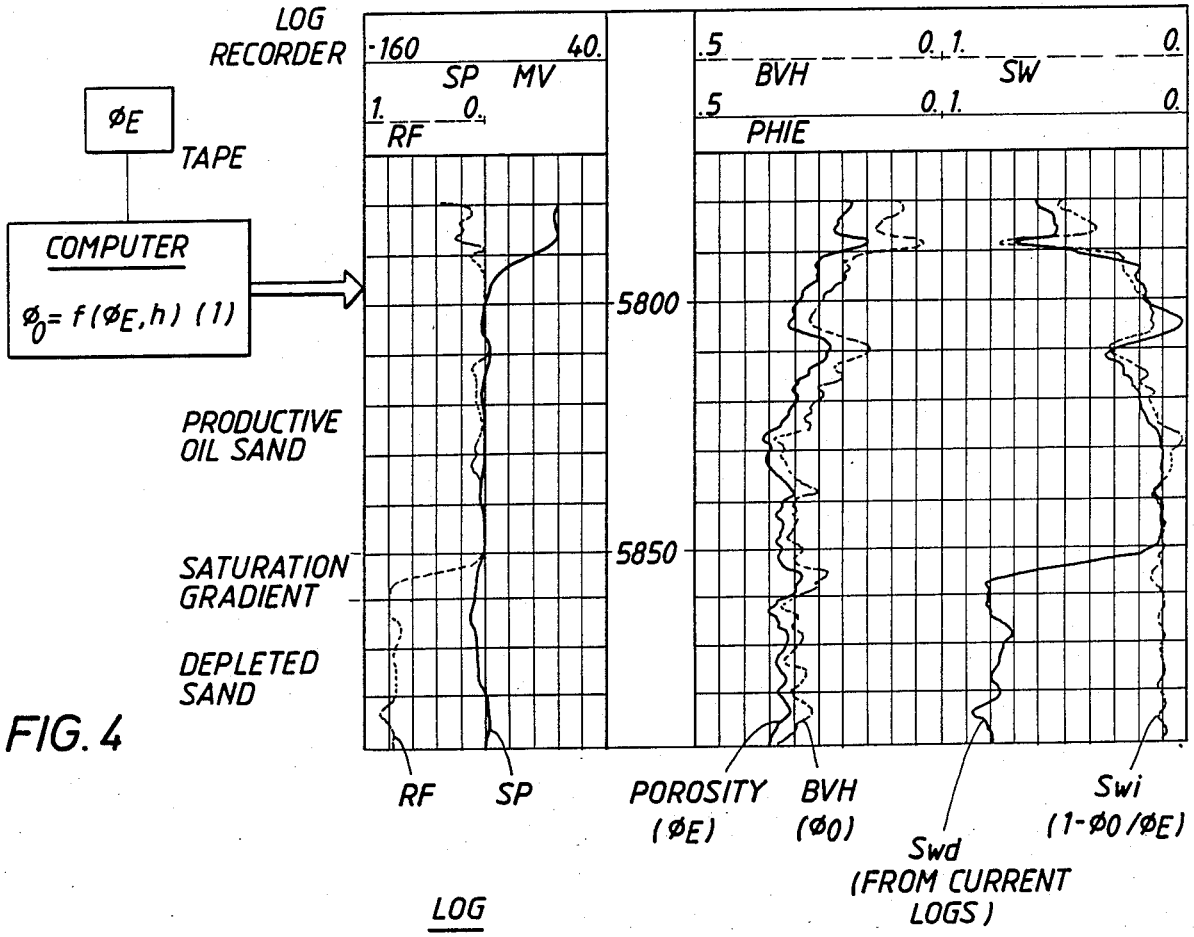
FIG. 4 is an illustration of the use of an effective porosity log previously obtained in combination with the bulk volume of oil relationship determined according to the invention to produce on a log recorder a log of $\phi_o$ and in combination with a log of Swd obtained from current logs to produce a log of recovery factor.

Equation (1) is useful to assess original bulk volume of oil $\phi_o$ or oil saturation, $S_o$, $$\left(S_o = \frac{\phi_o}{\phi_E}\right)$$

for a zone currently in production where a log of $\phi_E$ is available. Such an application of the use of core data from equation (1) is illustrated in FIG. 4 where the relation of the core data derived in equation (1) between $\phi_o$ and $\phi_E$ and h is combined with the original porosity $0_E$ from an open hole log to produce a recorded log of $\phi_o$ versus depth. The initial water saturation $S_{wi}=(1-\phi_o/\phi_E)$ is also presented on the log.

One of the problems facing a reservoir engineer is to obtain an appropriate recovery factor (RF) for a pay zone. The methods of this invention for developing a log of original water saturation $S_{wi}$ may be used to develop such a recovery factor log for a water-drive depleted zone.

For example, the present water saturation of a water-drive depleted zone $S_{wd}$ may be determined from current logs. The recovery factor is defined as $$RF = \frac{S_{wd} - S_{wi}}{1 - S_{wi}}.$$

For a given depleted zone, the RF may be plotted as a function of depth as illustrated in FIG. 4 as a log. The recovery factor may be applied to other wells in the field to provide better estimates for expected primary oil production. The RF log may be used to indicate whether or not actual production has met expected production.

Also shown on the log of FIG. 4 is the typical SP log. The RF log helps to distinguish the productive oil sand from the depleted oil sand.

For old wells however, porosity logs may not be available. If an original resistivity log exists for the well, it can be used to estimate bulk volume of oil and saturation that originally existed before production.

It is known that the bulk volume of water, BVW or $\phi_w$ of a formation can be expressed as $$\phi_w = \left(\frac{R_w}{R_t}\right)^{\frac{1}{n}}.$$

For said formations, n is usually from 1.8 to 2.0. Using the relationship, $$\phi_E = \phi_w + \phi_o,$$

equation (1) may be rearranged to the form, $$\phi_o = \frac{1}{1-C}\,[C\,(\phi_w) - K + g \log h], \text{ or} \quad (2)$$

$$\phi_o = \frac{1}{1-C}\left[C\left(\frac{R_w}{R_t}\right)^{\frac{1}{n}} - K + g \log H\right].$$

Figure 5:
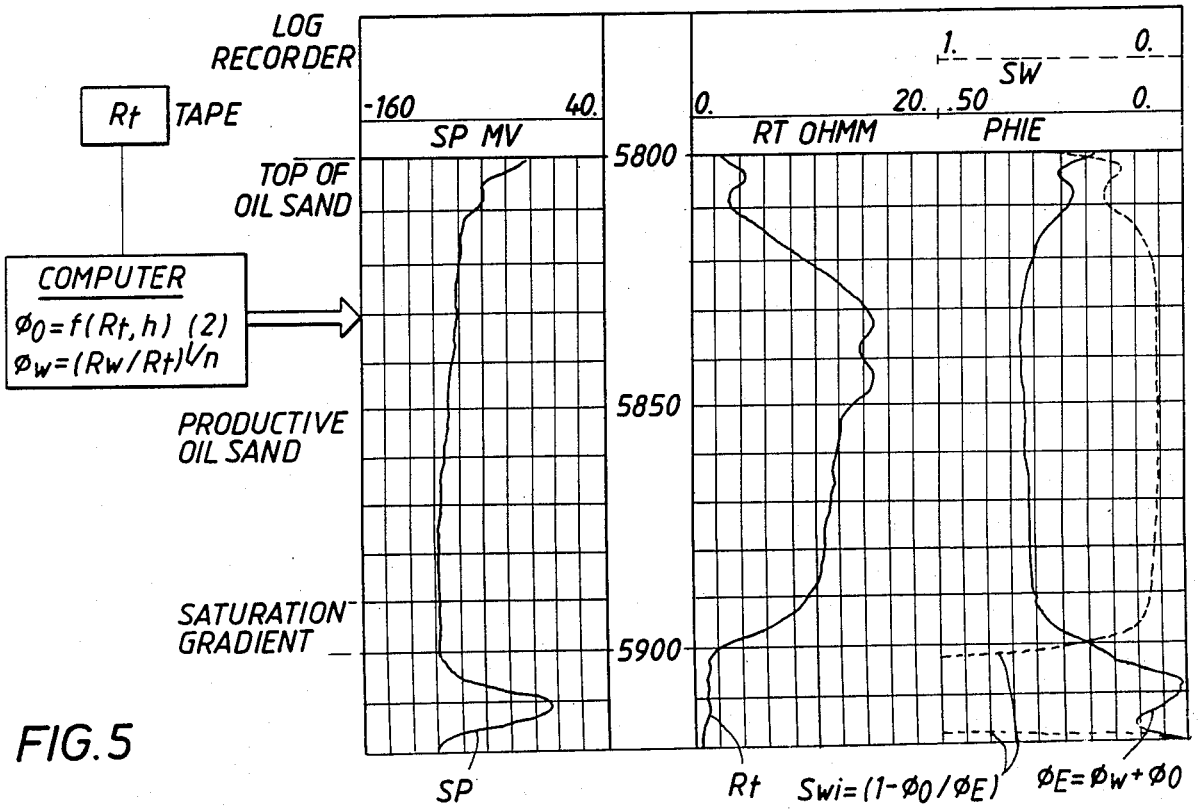
FIG. 5 illustrates a computer and log recorder with which the relationship determined from the steps of FIG. 3 is combined with an $R_t$ log to produce $\phi_E$ log versus depth.

FIG. 5 illustrates the case where $R_t$ as a function of depth is combined with the core data derived relationship of equation (2) to generate an original Bulk Volume of Oil log $\phi_o$ which with the relation $\phi_W = (R_w/R_t)^{1/n}$ and $\phi_E = \phi_W + \phi_o$ allows the generation of the log of $\phi_E$. The original water saturation $S_{wi}$ is determined and recorded from the relationship, $$S_{wi} = 1 - S_o = (1 - \phi_o/\phi_E).$$

The computed logs $\phi_E$ and $S_{wi}$ are presented on FIG. 5 along with the original logs of $R_t$ and $S_p$. The computed logs clearly illustrate the boundaries of an oil sand.

Determination of the Relation Between $\phi_o$, $\phi_E$ And h Where No Capillary Pressure Test Data Is Available From One Or More Wells Which Penetrate The Initial Oil-Water Contact Depth In many smaller oil fields where modern well logs are available, coring of the reservoir may not have been done, or even if cores were taken, capillary pressure tests of cores may not have been performed. The relationship of equation (1) between bulk volume of oil $\phi_o$, total effective porosity $\phi_E$, and height h to the initial oil-water contact may be determined from log data from one or more wells drilled in the reservoir.

For example, one or more logs of porosity $\phi_E(z)$ and resistivity $R_t(z)$ are assumed to exist as a function of depth (z) in the well, and are assumed to have been made before any significant water table movement occurred. The initial oil-water contact $z_c$ level may be identified from the well logs. The $R_t(z)$ log is especially well suited for this purpose because it measures the resistivity of fluid in the pores of the formation rock, and the resistivity of salt-water is distinguishable from that of oil. The resistivity $R_t(z)$ and porosity $\phi_E(z)$ may be associated with height h above the oil-water contact at any depth z above oil-water contact $z_c$. That is, the resistivity log $R_t(z)$ becomes $R_t(z-z_c)$, or simply $R_t(h)$, and the effective porosity $\phi_E(z-z_c)$, becomes simply, $\phi_E(h)$.

The initial water saturation $S_{wi}(h)$ may be drived, for example, from the $R_t(h)$ and $\phi_E(h)$ logs, through the well known relationship, $$S_w = \left(\frac{a\,R_w}{\phi^m\,R_t}\right)^{\frac{1}{n}}$$

where $R_w$ is obtained by a measurement of the resistivity of an uncontaminated sample of formation water or from an SP log and coefficients a, m, and n are constants known to characterize the reservoir formation. Such constants may be obtained from a core anlaysis of the formation. Bulk volume of hydrocarbon $\phi_o$, may then be determined from $S_w$, on a foot- by-foot basis as a function of h, by $$S_w + S_o = 1$$

$$S_o = \phi_o/\phi_E$$

$$\text{or } S_w + \phi_o/\phi_E = 1$$

$$\text{or } \phi_o = (1 - S_w)\phi_E$$

$$\text{or } \phi_o(h) = (1 - S_w(h))\phi_E(h)$$

As seen from the relationships above, $\phi_o$ and $\phi_E$ may each be measured or derived as a function of height h above the initial oil-water contact level.

At each level h, the relationship, $$\phi_o = C\phi_E - K + g \log h \quad (1)$$

may be written as function of the constants C, K, and g. Using well known statistical methods of multi-linear regression as described above, the best values of the constants, C, K, and g may be determined to describe the reservoir.

With the reservoir so described, that is by determining the constants C, K, and g of equation (1), then a log of BVH or $\phi_o$ may be determined and recorded, as illustrated in FIG. 4 for any other well in the reservoir as a function of $\phi_E(h)$ and h.

Determination Of Depth of Oil-Water Contact Of A Reservoir Where No Wells With Open-Hole Logs Have Been Drilled Deep Enough To Penetrate And Locate The Depth of The Oil-Water Contact, But Capillary Pressure Data Area Available From Analysis Of Cores Taken From One Or More Of The Wells a. Determination of Water Level WL

In some reservoirs, especially new ones, none of the wells drilled and logged may actually penetrate the oil-water contact. For that reason, it has been difficult to infer the depth of the oil-water contact level, or water level WL, from such logs. Yet it is important that an accurate determination of the water level be obtained to aid in estimating oil reserves and for determination of where and how deep to drill additional wells.

A method for determining WL, under such circumstances assumes that capillary pressure data are available from cores of the reservoir, and as described above, the constants C, K, and g of the equation $$\phi_o = C\phi_E - K + g \log h \quad (1)$$

are determined as a function of height h to the water level WL.

Equation (1) may be rearranged as $$h = 10^{(\phi_o - C\phi_E + K)/g} \quad (3)$$

where C, K and g are determined as above.

For a plurality of depth values z in the well, $\phi_o(z)$ and $\phi_E(z)$ may be determined as described above. For each depth z, the height to the water level may be determined. For each solution of equation (3), the depth of the water level, $$WL=z+h \quad (4)$$

may be determined. Although each water level WL determination, WL, may vary one from another with a statistical scatter, an average value ordinarily will be evident.

b. Determination of Capillary Equilibrium of Reservoir

If the method for determining water level is used in conjunction with equation (3) and (4) as above, there may, on occasions, be no central tendency or average value for WL. Water level WL may vary greatly or systematically for each calculation of depth h within a single well or when comparing WL among several wells. Such variation may infer that the reservoir may not be in capillary equilibrium or that the wells showing different WL may be in different reservoirs. Recognition of such capillary "dis-equilibrium" may be useful in subsequent development drilling and in reservoir evaluation.

Applicability Of Invention To Gas Or Gas Condensate Reservoirs

In all of the previous descriptions of the invention, the reservoir rock of interest was presumed to contain oil. All the relationships discovered and disclosed above and all of the applications of the invention in the field of reservoir analysis apply equally to gas or gas condensate reservoirs. Where $\phi_o$ is presented above, $\phi_g$ (and $BVH=\phi_g$) may be substituted. Likewise, the density of oil $d_o$ should be replaced by the density of gas, $d_g$, and the saturation of oil $S_o$ replaced by the saturation of gas $S_g$.

For example, equation (1) becomes, $$\phi_g=C\phi_e-K+g \log h \quad (5)$$

In this case of gas or gas-condensate, the value of the density of gas $d_g$ is the density of the gas at initial reservoir pressure and temperature conditions. Such density may be calculated from properties of the gas and condensate measured at surface conditions using well known reservoir engineering principles.

Various modifications and alterations in the described structures will be apparent to those skilled in the art of the foregoing description which does not depart from the spirit of the invention. For this reason, these changes are desired to be included in the appended claims. The appended claims recite the only limitation to the present invention and the descriptive manner which is employed for setting forth the embodiments and is to be interpreted as illustrative and not limitative.

What is claimed is:

1. A method for determining bulk volume of gas (BVG or $\phi_g$) as a function of depth and effective porosity in a zone of a produced well in which a log of effective porosity $\phi_E$ exists comprising the steps of, obtaining core samples from said zone corresponding to said zone of said produced well, testing said core samples to determine a first relationship of bulk volume of gas (BVG or $\phi_g$) as a function of capillary pressure $P_c$ and effective porosity $\phi_E$, that is, $\phi_g=f(\phi_E, P_c)$, determining the correspondence between capillary pressure $P_c$, and height h above the gas-free water contact of the zone of the form, $$P_c = \frac{(d_w - d_g)\,h}{K_1}$$

where $d_w$ is the density of the connate water of the zone, $d_g$ is the density of gas in the zone, and $K_1$ is a constant of proportionality, determining a second relationship of bulk volume of gas (BVG) as a function of total porosity $\phi_E$ of the formation and height h above the gas water contact depth of the zone of the form, $$\phi_g=C\phi_E-K+g \log h,$$

where C, K, and g are numerical constants, and recording a log of $\phi_g(h)$ from said second relationship by combining $\phi_E(h)$ data from a log of effective porosity for said zone.

2. The method of claim 1 wherein the step of obtaining core samples comprises the sub steps of forming a new well in the field in which said produced well is formed, and obtaining core samples from said new well in a zone corresponding to said zone of said produced well.

3. The method of claim 1 further comprising the step of determining the water saturation, $S_w(h)$ of the zone before production of gas from it by dividing $\phi_w(h)$ of the zone before production of gas from it by $\phi_E(h)$, that is, $$S_w(h) = \frac{\phi_w(h)}{\phi_E(h)},$$

or equivalently $$1 - \frac{\phi_g(h)}{\phi_E(h)}$$

and recording of $S_w(h)$.

4. The method of claim 3 further comprising the steps of determining the present water saturation $S_{wd}$ of a depleted zone from current logs of the zone, determining a recovery factor, $$RF = \frac{S_{wd} - S_w}{1 - S_w},$$

and recording said recovery factor as a function of depth in the zone.

5. A method for determining bulk volume of oil (BVO or $\phi_o$) as a function of depth above initial oil-water contact and effective porosity in a zone of a well in which a log of effective porosity $\phi_E$ exists and at least one other log exists from which a log of water saturation $S_{wi}$ may be derived, said logs having been made before any significant water table movement occurred, comprising the steps of identifying the initial oil-water contact depth $z_c$ from one of said logs, determining a log of water saturation $S_{wi}$ as a function of depth in the well z from said existing logs, determining a log of bulk volume of oil $\phi_o$ from said log of water saturation $S_{wi}$ as a function of distance $h=z-z_c$ above the oil-water contact depth, determining the constants C, K, and g from multiple equations of the form, $$\phi_o(h)=C\phi_E(h)-K+g \log h$$

where numerical values of $\phi_o$ and $\phi_E$ are determined as respective logs at distinct values of h, and recording a log of $\phi_o$(h) by combining $\phi_E$(h) data from a log of effective porosity for said zone.

6. The method of claim 5 wherein said constants C, K and g are determined by statistical regression methods.

7. A method for determining the level of oil-water contact of a reservoir where wells do not penetrate the oil-water contact level of said reservoir, but capillary pressure data are available from analysis of cores taken from a first well and a well log of the reservoir of effective porosity $\phi_E$ exists and at least one other well log of the reservoir exists from which a log of water saturation $S_{wi}$ may be derived, comprising the steps of determining from said capillary pressure data from said cores a relationship of bulk volume of oil ($\phi_o$) as a function of total porosity $\phi_E$ of the formation and height h above the oil-water contact level of the reservoir of the form, $$h=10^{(\phi o-C\phi E+K)/g},$$

where the constants C, K, and g are determined, determining a log of water saturation $S_{wi}$ as a function of depth z in said first well from said existing logs, determining a log of bulk volume of oil $\phi_o$ from said log of water saturation $S_{wi}$ as a function of depth z in said first well, and determining the oil-water contact level WL as a function of a plurality of depths z in said first well as $$WL(z)=z+h(z)$$

where h is determined from said relationship, $$h(z)=10^{(\phi(z)-C\phi E(z)+K)/g}.$$

8. The method of claim 7 whereby an estimate of the water-contact level WL of said first well is determined as the average value of a plurality of said WL(z) determinations of a plurality of depths z.

9. The method of claim 7 further comprising determining the capillary equilibrium of the reservoir form a statistical variation analysis of water contact levels WL as a function of a plurality of depths z.

10. The method of claim 7 wherein said oil-water contact level WL(z) is determined for at least a second well, and including the further step of determining capillary equilibrium of the reservoir from a statistical variation analysis of water contact levels WL of said first well and said second well as a function of a plurality of depths z to assess whether said first and second wells are within a single reservoir or in different reservoirs.

11. A method for determining bulk volume of oil (BVO or $\phi_o$) as a function of depth and effective porosity in a zone of a produced well in which a log of effective porosity $\phi_E$ exists comprising the steps of, obtaining core samples from said zone corresponding to said zone of said produced well, testing said core samples to determine a first relationship of bulk volume of oil (BVO or $\phi_o$) as a function of capillary pressure $P_c$ and effective porosity $\phi_E$, that is, $\phi_o=f(\phi_E, P_c)$, determining the correspondence between capillary pressure $P_c$, and height h above the oil-free water contact of the zone of the form, $$P_c=\frac{(d_w-d_o)\,h}{K_1}$$

where $d_w$ is the density of the connate water of the zone, $d_o$ is the density of oil in the zone, and $K_1$ is a constant of proportionality, determining a second relationship of bulk volume of oil (BVO) as a function of total porosity $\phi_E$ of the formation and height h above the oil water contact depth of the zone of the form, $$\phi_o=C\phi_E-K+(g\times h),$$

where C, and g are numerical constants, and recording a log of $\phi_o$(h) from said second relationship by combining $\phi_E$(h) data from a log of effective porosity for said zone.

12. The method of claim 11 wherein the step of obtaining core samples comprises the sub steps of forming a new well in the field in which said produced well is formed, and obtaining core samples from said new well in a zone corresponding to said zone of said produced well.

* * * * *